US006853308B1

(12) United States Patent
Dustin

(10) Patent No.: US 6,853,308 B1
(45) Date of Patent: Feb. 8, 2005

(54) MULTI-SIDED REMOTE CONTROL DEVICE

(75) Inventor: Kurt Dustin, Pennington, NJ (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 379 days.

(21) Appl. No.: 09/631,399

(22) Filed: Aug. 3, 2000

(51) Int. Cl.[7] ..... G08C 19/00
(52) U.S. Cl. ..... 340/825.69; 340/825.72
(58) Field of Search ..... 340/825.69, 825.29, 340/5.62, 825.36, 825.72; 341/23, 26, 176, 22; 359/142; 346/22; 206/320, 305, 328

(56) References Cited

U.S. PATENT DOCUMENTS

| | | | | | |
|---|---|---|---|---|---|
| 4,324,976 | A | * | 4/1982 | Lapeyre | 235/145 R |
| 4,762,227 | A | * | 8/1988 | Patterson | 206/320 |
| 4,836,256 | A | * | 6/1989 | Meliconi | 206/523 |
| 4,878,055 | A | * | 10/1989 | Kasahara | 341/23 |
| 5,005,084 | A | * | 4/1991 | Skinner | 358/194.1 |
| 5,092,459 | A | * | 3/1992 | Uljanic et al. | 206/320 |
| 5,316,141 | A | * | 5/1994 | Jalomo | 206/320 |
| 5,376,934 | A | * | 12/1994 | Savazzi | 341/22 |
| 5,748,135 | A | * | 5/1998 | Kriegsman et al. | 341/176 |
| 5,774,187 | A | * | 6/1998 | Tsunoda | 348/553 |
| 5,798,715 | A | * | 8/1998 | Saperstone | 341/22 |
| 5,831,555 | A | * | 11/1998 | Yu et al. | 341/26 |
| D406,847 | S | | 3/1999 | Gerba et al. | D14/218 |
| 5,973,757 | A | * | 10/1999 | Aubuchon et al. | 348/734 |
| 6,094,156 | A | * | 7/2000 | Henty | 341/176 |
| 6,374,164 | B1 | * | 4/2002 | Eklind et al. | 701/2 |
| 6,492,997 | B1 | * | 12/2002 | Gerba et al. | 345/721 |

FOREIGN PATENT DOCUMENTS

| | | | |
|---|---|---|---|
| EP | 0 185 143 | | 6/1986 |
| GB | 2146813 A | * | 4/1985 |
| JP | 10 066162 | | 3/1998 |
| JP | 2001 000494 | | 1/2001 |
| WO | WO 93/14567 | | 7/1993 |

OTHER PUBLICATIONS

Search Report, Nov. 8, 2002.

* cited by examiner

*Primary Examiner*—Michael Horabik
*Assistant Examiner*—Nam Nguyen
(74) *Attorney, Agent, or Firm*—RatnerPrestia

(57) ABSTRACT

A remote control device for use with a plurality of devices has an exterior surface having a plurality of sides. Button groups are located on at least two sides of the plurality of sides. Each button group comprises at least one device button. A device button controls a device, indicates the status of a device, or both. At least one button group on the first side is duplicated on the second side. The remote control device also includes a cover that may be used to the button groups on one side of the remote control device when the button groups on the other side are being used. In one embodiment of the invention, the button group on the second side includes a power button, channel selection buttons and volume control buttons.

8 Claims, 7 Drawing Sheets

MULTI-SIDED REMOTE CONTROL DEVICE

FIELD OF THE INVENTION

This invention relates to remote control devices and more specifically to a remote control device having controls on more than one side.

BACKGROUND OF THE INVENTION

It is well understood that viewers and listeners (herein referred to as viewers) generally wish to avoid the annoyance of controlling a device by having to traverse a distance and being in physical contact with the device. The annoyance increases when the viewer is incapacitated, the distance is great, frequent changes must be made, or several devices (e.g. TV, VCR, DVD player, stereo receiver) need to be controlled. This has led to the creation of various remote control methods and mechanisms which allow a viewer to control multiple devices from a resting position.

The first remote control devices were used mainly for military purposes. Radio-controlled motorboats, developed by the German navy, were used to attack enemy ships in World War I. Radio controlled bombs and other remote control weapons were used in World War II. Following World War II, United States scientists developed several nonmilitary uses for the remote control device. Automatic garage door openers became popular in the late 1940's, and the first TV remote control devices were used in the 1950's.

Early in the 1950's, a television remote control device was developed having a long cable attached to the television. Pushing buttons on the remote activated a motor that would rotate the tuner in the television.

Several types of wireless television remote control devices have been developed, including optical, ultrasonic and infra-red controls. In 1955, a remote control device using a flashlight and light receptive sensors was developed. The light receptive sensors were positioned at each of the four corner of the television. The flashlight was shined toward a specific light receptive sensor to control a particular function, such as on, off, volume, and channel tuning. A disadvantage of this remote control device was that people often forgot which corner of the TV operated which control. Also, ambient light, such as sunlight, could erroneously affect control of the television.

Later in the 1950's, ultrasonic television remote control devices were developed. A problem with the ultrasonic television remote control device was that the ultrasonic receptors were sensitive to interference from noise generated by clinking metal. Also, the high frequencies generated by the ultrasonic transmitter were known to cause dogs to bark. The ultrasonic remote was used for approximately two decades until the infrared remote control device was developed.

Modern infra-red remote control devices operate by emitting a respectively different serial stream of infra-red pulses for each control on the remote control device. The remote control device includes an infra-red photodiode that emits the pulses. The receiver typically includes a infra-red phototransistor that receives the pulses. The coded pulse streams are decoded in the receiver, for example, by a microprocessor, to implement the desired functions. Typically, each manufacturer has a distinct set of codes for each different type of device that it sells.

Today, the number of television channels and programs that a viewer may receive at any given time has increased to over several hundred. Conventional analog television systems such as those conforming to the National Television Standards Committee (NTSC) and Phase Alternate Line (PAL) standards transmit one program per 6 MHz or 8 MHz channel. Recently, digital television signal processing techniques have been developed that allow multiple programs to be transmitted in each 6 MHz channel. Furthermore, there are now many sources of television signals. In addition to the conventional broadcast antenna, a viewer may receive television signals via wired cable systems, several different types of satellite systems, so-called wireless cable systems and, in the near future, via a global information network, such as the Internet.

Conventional cable television systems are capable of delivering at least 140 six MHz channels and some systems are capable of delivering over 200 channels via a coaxial cable. Presently, new technology is being implemented to increase the number of programs that can be delivered to the home. This is being done via two technologically strategic moves. The first is to increase the allocated bandwidth to one GHz (which provides for 150, six MHz channels). The second is to use video compression to configure a channel to carry up to ten minor channels in one six MHz wide channel. Channels that include a plurality of minor channels are also known as multiprogram channels. Typical numbers that are used in the industry estimate that about 500 programs can be delivered to the home over a single coaxial cable. Fiber optic cable provides many times the bandwidth of a coaxial cable and promises to be able to provide several thousand programs. In the same way, increased bandwidth for satellite systems may allow a viewer to receive upwards of one thousand six MHz channels, each channel containing up to ten minor channels.

To make matters more complex, a typical home entertainment system includes many devices that may be controlled by an infra-red remote control device. It is not uncommon for a viewer's entertainment center to have a television, a radio receiver an multi-channel amplifier, and a video cassette recorder (VCR). Other common devices include DVD players, CD players, set top boxes, cable converters, satellite receivers, audio tape players, and digital audio tape players (DATs). Each device has several controllable functions, and many of these devices require the viewer to control functions unique to that device (e.g., VCR still frame, programming commands). Often, two or more of these devices are being used concurrently. In a home theatre configuration, for example, a DVD player may be used to provide the video and audio portions of a program. The video portion is displayed on a monitor while the audio portion is played through the amplifier in the viewer's receiver. With the increasing number of devices, the increasing number channels, and the increasing number of functions, many remote control devices multiplex functions, for example, the volume controls for the stereo receiver and the television receiver may share a single group of control buttons since it is unlikely that they will be used at the same time. This multiplexing of functions, however, makes the remote control device more confusing to operate.

SUMMARY OF THE INVENTION

The present invention is embodied in a remote control device for use with a plurality of devices. The remote control device comprises an exterior surface having a plurality of sides. Button groups are located on at least two sides of the plurality of sides. Each button group comprises at least one device button. A device button controls a device, indicates the status of a device, or both.

According to one aspect of the invention, the remote control device has a first side and a second side, and at least one common button group is located on each of the first side and second side.

According to another aspect of the invention, the at least one common button group includes a channel selection button group, a volume control button group and a power control button.

According to another aspect of the invention, the remote control device includes a cover that is configured to be positioned over the side that is not being used to prevent spurious activation of controls on the side that is not being used.

According to yet another aspect of the invention, the remote control device includes at least one button group on a third side of the remote control device.

According to another aspect of the invention, the remote control device includes at least one control button on four sides of the remote control device.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1A:
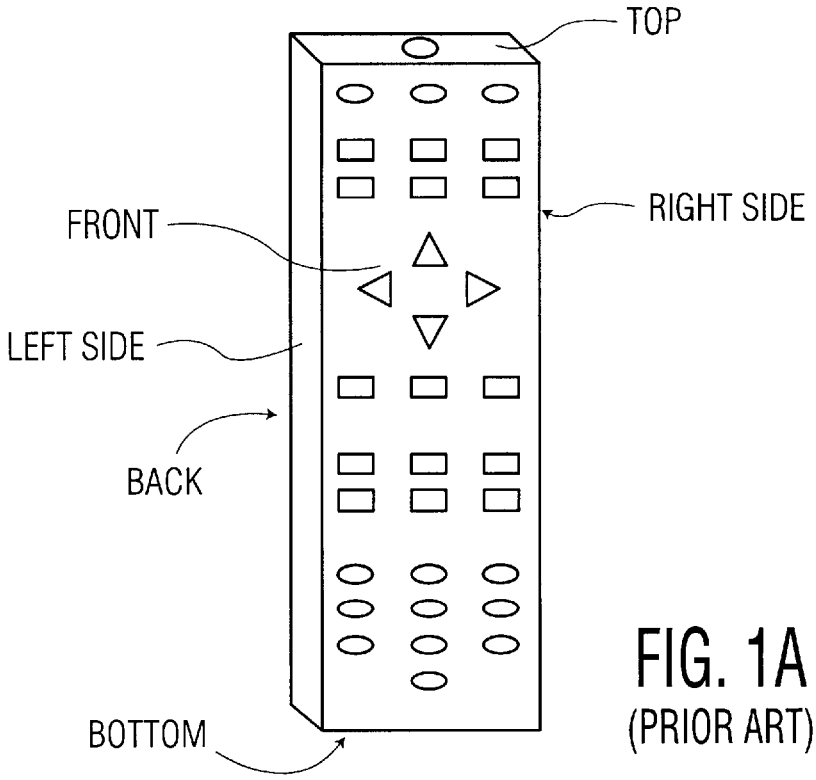
FIG. 1A (PRIOR ART)
FIGS. 1A and 1B (Prior Art) are isometric views of a typical remote control device.
Figure 1B:
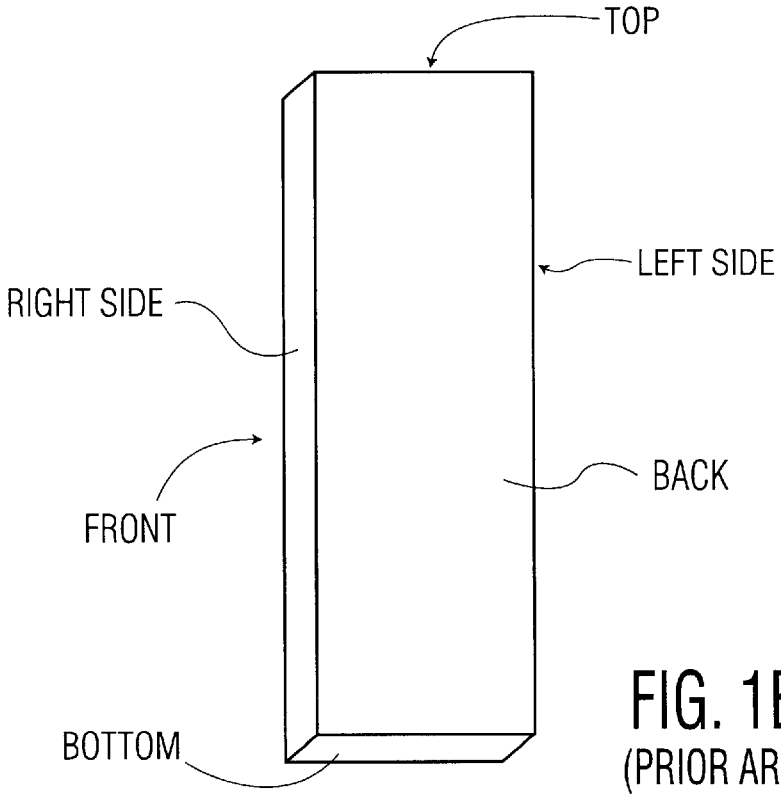
FIG. 1B (PRIOR ART)

FIGS. 1A and 1B (Prior Art) show a typical remote control device. FIG. 1A shows the front, top, and left sides of a remote control device. FIG. 1B shows the back, right, and bottom sides of the remote control device shown in FIG. 1A. Only the front side, as shown in FIG. 1A, has controls and/or indicators. The left, right, top, and bottom sides of the remote control device shown in FIGS. 1A and 1B do not have controls and/or indicators.

Figure 2A:
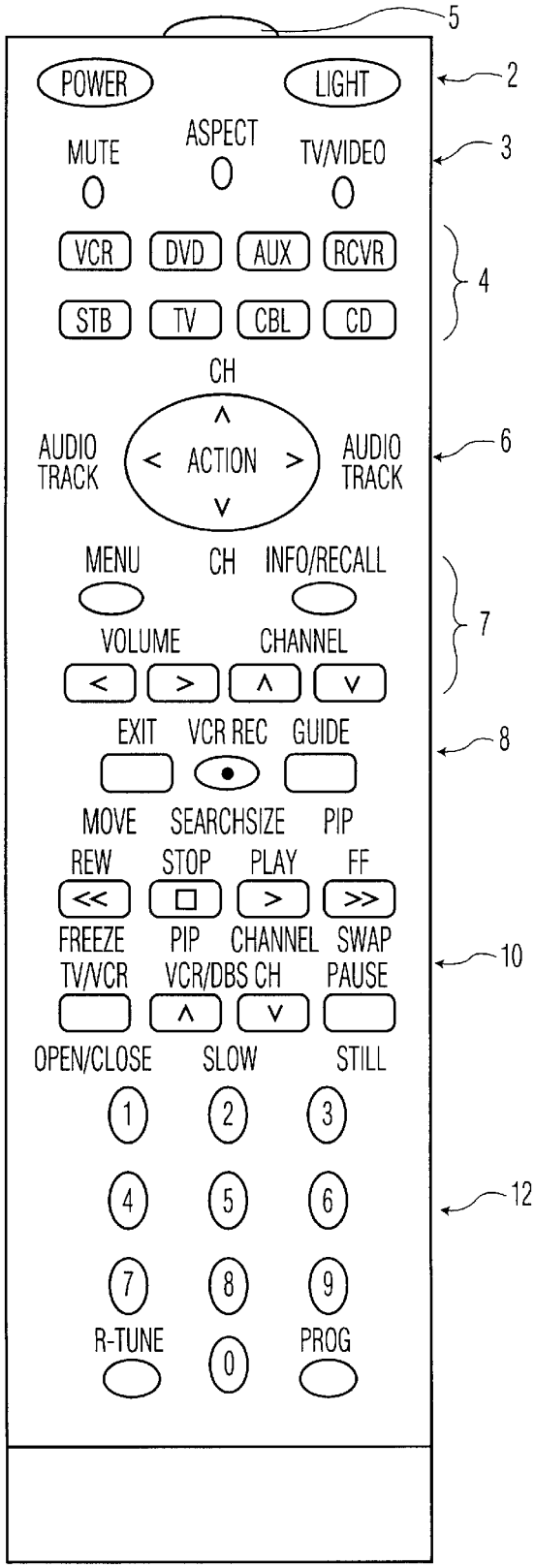
FIG. 2A is a front plan view of an exemplary remote control device according to the present invention.
Figure 2B:
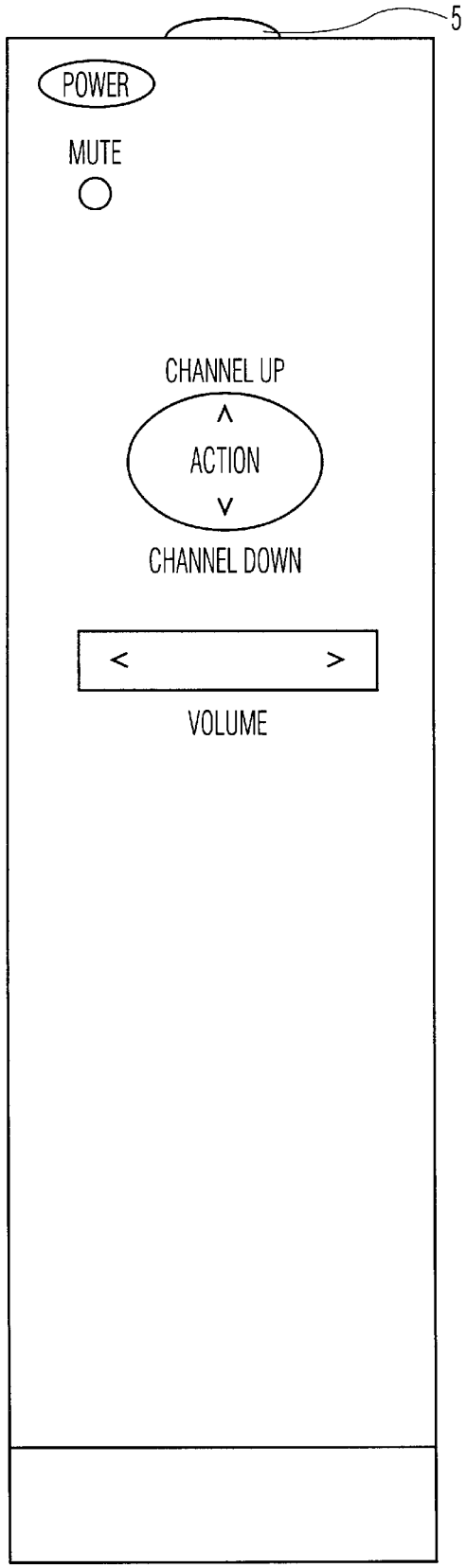
FIG. 2B is a back plan view of the exemplary remote control device shown in FIG. 2A.

FIGS. 2A and 2B depict an exemplary embodiment of a remote control device in accordance with the present invention. Both the front and back sides of the remote control device shown in FIGS. 2A and 2B have control buttons and/or indicators. The positioning and functionality of the controls and indicators shown in FIGS. 2A and 2B are exemplary.

The control button configuration shown in FIG. 2A illustrates the complexity of a modern multi-function remote control device. The top row of buttons 2 includes a power button and a "Light" button that illuminates the buttons so that the device can be used in a darkened room. The next row 3 of buttons includes a "Mute" button that mutes the audio portion of the television program, an "Aspect" button that allows a viewer to change the aspect ratio of the video portion of a television program, and a "TV/Video" button that allows a viewer to select the signal to be displayed on the monitor from either the television tuner or the video inputs to the monitor.

The button group 4 allows a viewer to select the device to be controlled by the remote control device from among a video cassette recorder (VCR), digital versatile disc (DVD) player, multi-channel audio receiver (RCVR), set-top box (STB), television (TV), cable converter (CBL), compact disk (CD) player or an auxiliary (AUX) device. The auxiliary button may be used, for example, to control a satellite receiver.

The action button 6 is active when any of its sides is pressed or when the center is pressed. When the television is selected using button group 4, the up and down arrows of the action button 6 control the television tuner and the right and left arrows control the television volume. When the VCR is selected, however, the up and down arrows control the VCR tuner and the right and left arrows control the VCR tracking. When the set-top box is selected, the center of the action button 6 may be used to select options from a menu while the up, down, right and left arrows are used to scroll through the menu.

Button group 7 includes a "Menu" button, an "Info/Recall" button, and auxiliary volume control and channel switching buttons. The "Menu" button changes the function of the action button 6 to navigate through menus and select items from the menu for whatever device has been selected using button group 4. The "Info/Recall" button provides more information on menu items when the menu for the selected device is active and toggles back to the previously selected television or VCR channel when the menu is not active. The auxiliary volume control and channel switching buttons allow the viewer to control the selected channel and sound volume when the action button 6 is being used for another purpose.

Button group 8 includes three buttons, each of which has at least two functions. These are the "Exit/Move" button, the "VCR Rec/Search/Size" button and the "Guide/PIP" buttons. The "Exit/Move" button is pressed to exit the menu mode or to move the inset image to a different position on the screen when the picture-in-picture (PIP) function is active. The "VCR Rec/Search/Size" button places the VCR in record mode when it is pressed at the same time as the "Play" button, described below. When the VCR is selected and this button is pressed alone, it causes the VCR to search the tape for the start of the next taped event. If the PIP function is active, this button changes the size of the inset image. The "PIP/Guide" button toggles the PIP function when the television device is selected in button group 4 or activates the electronic program guide (EPG) when a device having an EPG feature (e.g. the cable converter) is selected.

Button group 10 includes eight buttons the top four buttons control the rewind, stop, play and fast forward functions of the VCR, DVD or CD devices. Alternatively, when the television device is selected, these buttons control aspects of the PIP function, allowing a viewer to freeze the current inset image, change the channel displayed in the inset image or swap the inset and main images.

The bottom set of buttons of group 10 toggle the PIP display between the VCR tuner and the auxiliary television tuner (TV/VCR), select the channel tuned by the VCR or satellite tuner when the other channel select buttons are being used for other purposes (VCR/DBS CH), or pause the VCR, DVD or CD devices (Pause). Alternatively, these buttons open and close the media drawers of the DVD and CD players (Open/Close), control the video slow-play feature of the VCR or DVD, or display a still image from the VCR or DVD (Still).

The button group 12 includes 10 buttons that are used to enter specific channel numbers an: "R-Tune" and a "Prog" button. The "R-Tune" button has the same function as the "Recall" button in button group 7 and the "Prog" button allows the remote control device to be programmed so as to provide proper codes for a new device.

As can be seen from the description presented above, the typical remote control device includes many buttons having multiplexed functions that can be confusing for a viewer. Many of the functions on the remote control device are used only to select a program source (e.g. TV, VCR, DVD, stereo receiver). Once the program is selected, only a minimal number of control buttons are actually used. These may include, for example, channel up, channel down, volume up, volume down, mute and power. An exemplary remote control device according to the present invention places control buttons that perform these minimal control functions for the selected device(s) on the back side of the remote control device, providing the viewer with a simplified interface once the program source has been selected.

FIG. 2B is a back-plan view of the remote control device shown in FIG. 2A that illustrates an exemplary minimal set of control buttons. These include a power button, a mute button, an action button for changing channels and a volume control button. In the exemplary embodiment of the invention, the device controlled by each of these buttons depend on the current configuration of the total system. If for example, the viewer has selected the digital television set-top box (STB) to provide the signal where the sound signal from the STB is routed to the multi-channel amplifier of the receiver, the channel select buttons control the STB while the volume control buttons and mute button may control the receiver. Alternatively, the volume control and mute buttons may control a preamplifier in the STB to control the volume of the sound produced by the receiver. If only the television receiver is selected, then the channel up and channel down buttons control the television tuner while the volume and mute buttons control the television sound circuitry.

The present invention mitigates another annoyance in the use of remote control devices: accidentally pressing a wrong button. The simplified layout of the back side of the remote control device eliminates extraneous buttons and, thus, removes the danger that one of these buttons will be pressed accidentally. In addition, an exemplary remote control device according to the present invention includes a cover 13 that may be placed over the side of the remote control device that is not being used to prevent buttons on that side of the device from being pressed while the controls on the other side are being used.

Figure 2C:
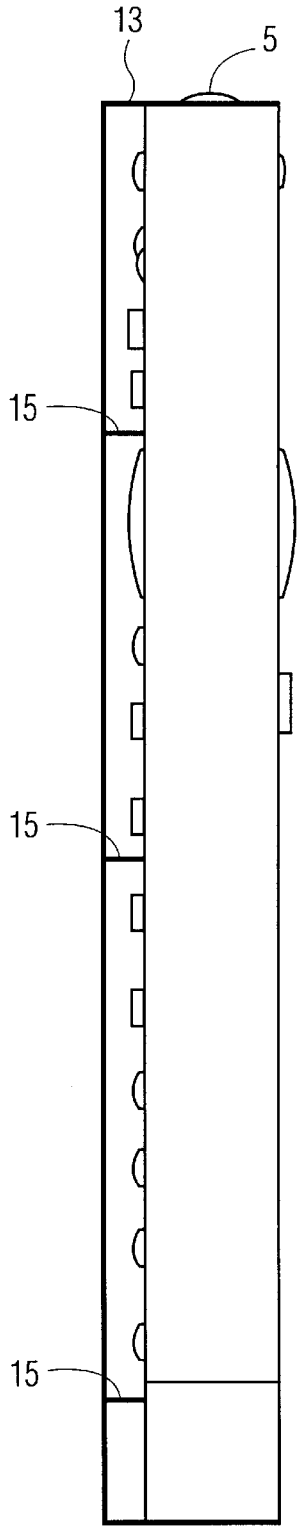
FIGS. 2C and 2D are side plan views of the remote control device shown in FIGS. 2A and 2B that illustrate the operation of the device cover.
Figure 2D:
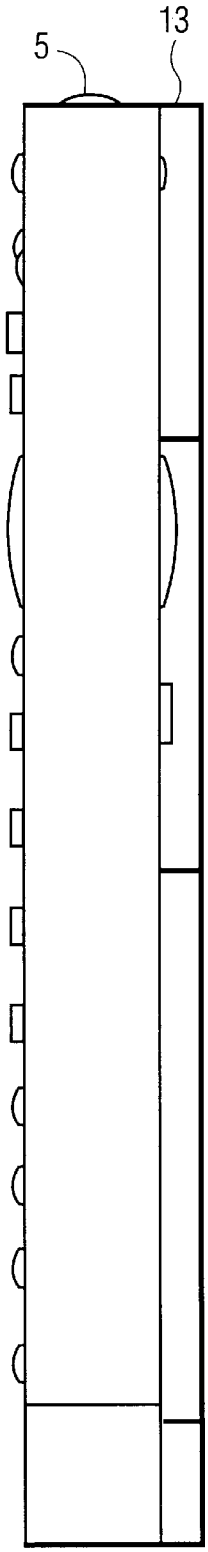

An exemplary cover 13, shown in FIGS. 2C and 2D, completely covers either the front (FIG. 2C) or the back (FIG. 2D) of the remote control device. It includes an opening on its top side to allow infra-red radiation from the photodiode to be emitted. The right and left sides of the cover are open to allow the cover to be removed easily and to allow access to optional control buttons that may be mounted on the side of the device, as described below. The cover also includes supporting spacers 15 positioned not to interfere with any of the control buttons. These spacers hold the cover above the buttons on the inactive side of the remote control device even when buttons on the active side are pressed. The cover may include bumps (not shown) on the inside of its top and bottom sections that engage with corresponding indentations (not shown) on the top and bottom of the remote control device to hold the cover in place. This configuration of the cover is only exemplary. Any cover that blocks one side of the remote control device while allowing the other side to be used may be used. Alternatively, the remote control device may include a switch (not shown) that selectively deactivates the controls on one side and simultaneously activates the controls on the other side.

Figure 3A:
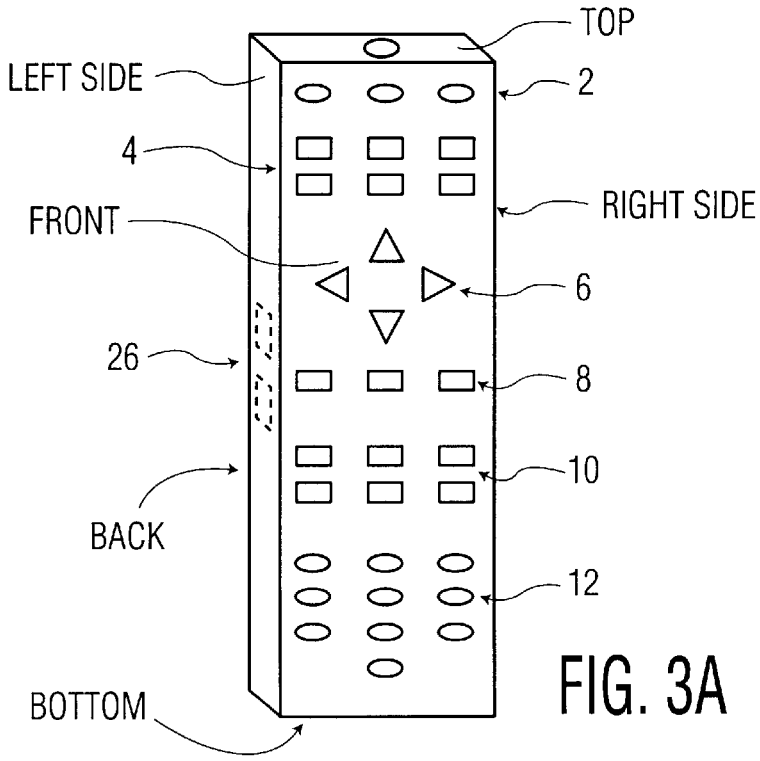
FIGS. 3A and 3B are isometric views of an exemplary embodiment of a remote control device having button groups on more than two sides of the remote control device, in accordance with the present invention.
Figure 3B:
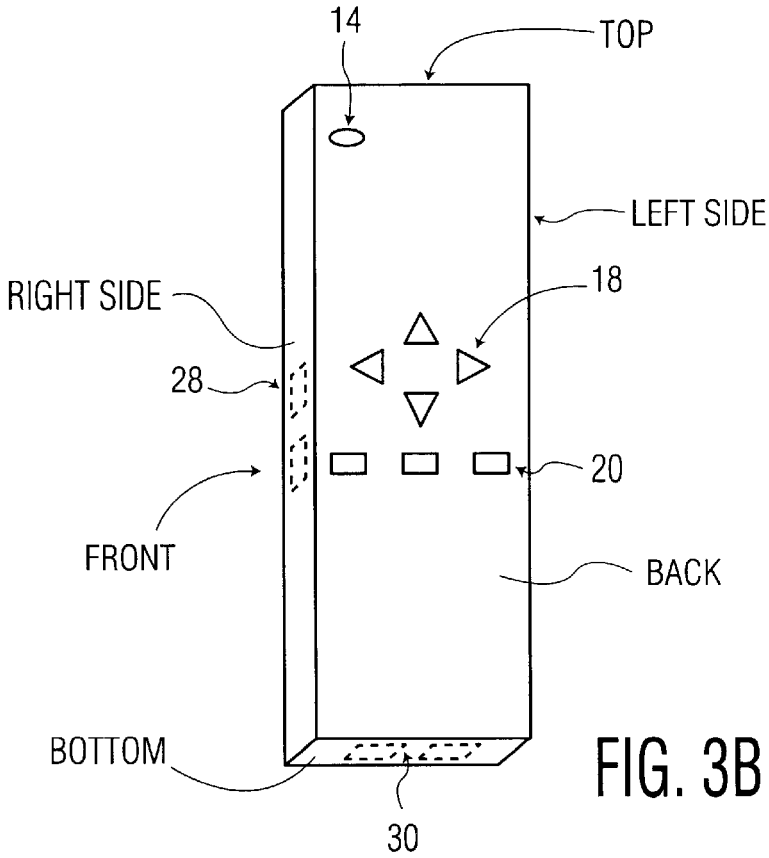

FIGS. 3A and 3B depict another exemplary embodiment of the invention. In this embodiment of the invention, additional controls and/or indicators are located on the sides and bottom of the remote control device. As shown in FIGS. 3A and 3B, button groups 26 and 28 are located on the left side and right side respectively, and button group 30 is located on the bottom of the remote control device. The location of these button groups is exemplary. For example, button groups may be located on any two sides, or any combination of front, back, left side, right side, top and bottom. If a control button is located on the top of the remote control device, it should be placed so that it does not interfere with the operation of the infra-red photodiode. It is envisioned that button groups located on the side or bottom comprise controls and/or indicators which are frequently used (e.g., volume, on/off or channel status).

Figure 4A:
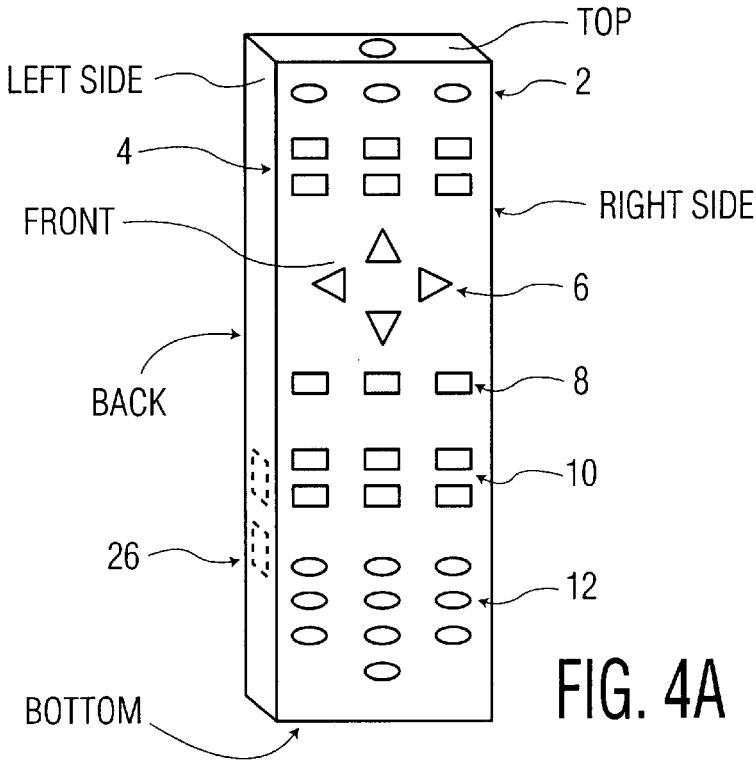
FIGS. 4A and 4B are isometric views of an exemplary embodiment of a remote control device having portions of the physical locations, characteristics, and functionality of the button groups on different sides of the remote control device differ in accordance with the present invention.
Figure 4B:
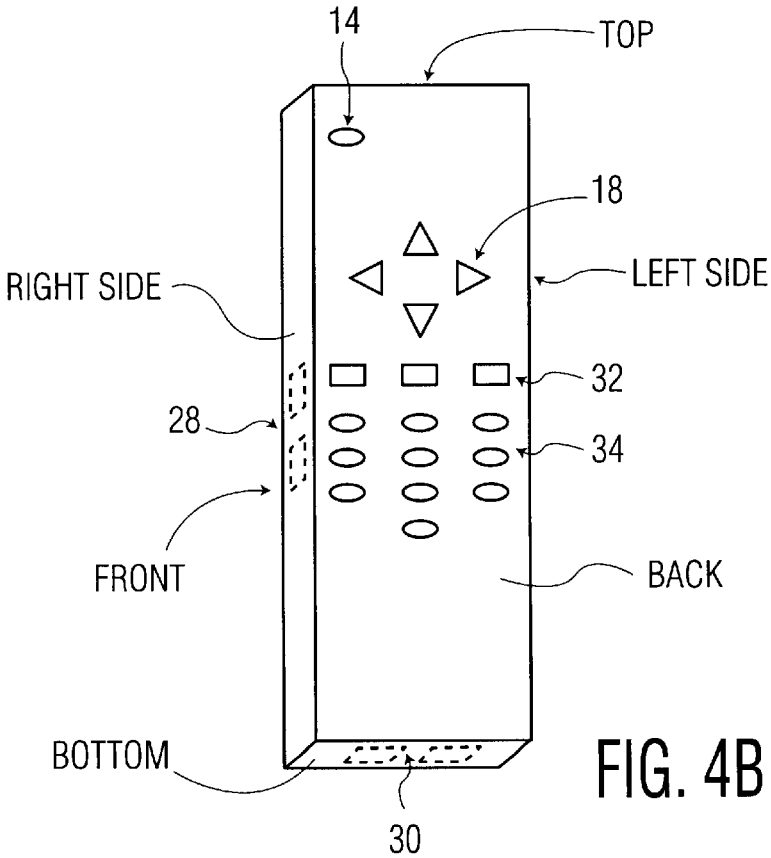

FIGS. 4A and 4B depict an exemplary embodiment of the invention wherein a portion of the physical locations, characteristics, and functionality of the button groups on different sides of the remote control device differ. In the exemplary embodiment shown in FIGS. 4A and 4B, at least one button of button group 2 is equivalent to button and button group 6 is equivalent to button group 18. It is envisioned that button groups 32 and 34 control and tune the selected device.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

What is claimed is:

1. A remote control device for use with a plurality of devices, said remote control device comprising:

an exterior surface having a plurality of sides including a first side and a second side; and a plurality of button groups located on at least the first and second sides of the exterior surface, wherein each button group comprises at least one device button for at least one of controlling a device and indicating a status of a device;

wherein at least one button located on the second side is a replica of at least one button of a button group located on the first side both in function and relative position, and the button located on the first side and the button located on the second side are both used to control or indicate status of the same device, and all buttons located on the second side have functions which correspond to functions of respective ones of the, buttons located on the first side.

2. A remote control device in accordance with claim 1 further comprising a cover adapted to be placed over one of buttons and button groups located on the first side when the button groups on the second side are being used and to be placed over one of buttons and button groups located on the second side when the button groups on the first side are being used.

3. A remote control device in accordance with claim 1 wherein:

the first side includes a first button group that selects a particular device to be controlled from among the plurality of devices; and the selection of the particular device using the first button group determines which device is controlled by the at least one button group on the second side.

4. A remote control device in accordance with claim 3, wherein the at least one button group on the second side includes a channel select button and a volume control button.

5. A remote control device in accordance with claim 1 wherein at least one button group is located on each of three sides of said plurality of sides.

6. A remote control device in accordance with claim 1 wherein at least one button group is located on each of four sides of said plurality of sides.

7. A remote control device in accordance with claim 1, wherein a plurality of buttons located on the second side is a replica of a plurality of buttons located on the first side both in function and relative position, and the plurality of buttons located on the first side and the plurality of buttons located on the second side are used to control or indicate status of the same device.

8. A remote control device in accordance with claim 1, wherein each of the buttons located on the second side is a replica of a respective button located on the first side such that the buttons on the second side form a subset of the buttons on the first side.

* * * * *